US011757219B2

(12) United States Patent
Wu

(10) Patent No.: US 11,757,219 B2
(45) Date of Patent: Sep. 12, 2023

(54) ELECTRICAL CONNECTOR WITH IMPROVED SAFETY FEATURES

(71) Applicant: Cheng Uei Precision Industry Co., LTD., New Taipei (TW)

(72) Inventor: Yun Wu, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 57 days.

(21) Appl. No.: 17/535,568

(22) Filed: Nov. 24, 2021

(65) Prior Publication Data

US 2022/0285866 A1 Sep. 8, 2022

(30) Foreign Application Priority Data

Mar. 4, 2021 (CN) ..... 202120472269.5

(51) Int. Cl.

| | |
|---|---|
| ***H01R 12/71*** | (2011.01) |
| ***H01R 13/52*** | (2006.01) |
| ***H01R 13/6581*** | (2011.01) |
| ***H01R 12/70*** | (2011.01) |
| *H01R 13/6585* | (2011.01) |
| *H01R 13/6596* | (2011.01) |

(Continued)

(52) U.S. Cl.

CPC ..... *H01R 12/716* (2013.01); *H01R 12/707* (2013.01); *H01R 13/5216* (2013.01); *H01R 13/6581* (2013.01); *H01R 12/70* (2013.01); *H01R 12/7011* (2013.01); *H01R 12/71* (2013.01); *H01R 12/712* (2013.01); *H01R 13/648* (2013.01); *H01R 13/658* (2013.01); *H01R 13/6585* (2013.01); *H01R 13/6591* (2013.01); *H01R 13/6596* (2013.01); *H01R 13/6597* (2013.01)

(58) Field of Classification Search

CPC ..... H01R 12/716; H01R 12/707; H01R 13/5216; H01R 13/6581; H01R 12/70; H01R 12/7011; H01R 12/71; H01R 12/712; H01R 13/648; H01R 13/658; H01R 13/6585; H01R 13/6591; H01R 13/6596; H01R 13/6597

See application file for complete search history.

(56) References Cited

U.S. PATENT DOCUMENTS

2018/0115118 A1* 4/2018 Zhao ..... H01R 13/6585

FOREIGN PATENT DOCUMENTS

CN 110994250 A * 4/2020

* cited by examiner

*Primary Examiner* — Abdullah A Riyami
*Assistant Examiner* — Justin M Kratt
(74) *Attorney, Agent, or Firm* — Cheng-Ju Chiang

(57) ABSTRACT

An electrical connector includes an insulation body, a main plate, a side plate and a plurality of terminals. The insulation body has at least one aperture penetrating through an upper surface and a lower surface of the insulation body. The main plate is fastened in the insulation body. The side plate is fastened in the insulation body. The side plate is disposed to one side of the main plate. The main plate has a first corresponding side. The side plate has a second corresponding side. The second corresponding side is corresponding to the first corresponding side in the at least one aperture. The first corresponding side and the second corresponding side are exposed to an outside of the insulation body through the at least one aperture. The plurality of the terminals are mounted in the insulation body.

11 Claims, 11 Drawing Sheets

(51) Int. Cl.

| | |
|---|---|
| *H01R 13/6597* | (2011.01) |
| *H01R 13/658* | (2011.01) |
| *H01R 13/648* | (2006.01) |
| *H01R 13/6591* | (2011.01) |

ELECTRICAL CONNECTOR WITH IMPROVED SAFETY FEATURES

CROSS-REFERENCE TO RELATED APPLICATION

The present application is based on, and claims priority from, China Patent Application No. 202120472269.5, filed Mar. 4, 2021, the disclosure of which is hereby incorporated by reference herein in its entirety.

BACKGROUND OF THE INVENTION

1. Field of the Invention

The present invention generally relates to an electrical connector, and more particularly to an electrical connector having a better safety performance for protecting the electrical connector and a user.

2. The Related Art

Usually, various connectors are frequently used by various electronic products. Universal Serial Bus (USB) connectors are the most popularly used in the various electronic products. With the advancement of science and technology, more and more types of the USB connectors are developed, such as USB 2.0 connectors, USB 3.0 connectors, Micro USB connectors, Mini USB connectors or USB Type C connectors. The USB Type C connectors are widely used in the various electronic products.

However, when a user uses the electrical connector, the user accidentally touches water or other liquids, and the electrical connector is charged before the electrical connector is completely dried, consequently, the electrical connector will aggravate a corrosion of a copper material of the electrical connector, and the electrical connector causes a danger in use.

Therefore, it is necessary to provide an innovative electrical connector, the electrical connector has a better safety performance for protecting the electrical connector and a user.

SUMMARY OF THE INVENTION

An object of the present invention is to provide an electrical connector having a better safety performance for protecting the electrical connector and a user. The electrical connector includes an insulation body, a main plate, a side plate and a plurality of terminals. The insulation body has at least one aperture penetrating through an upper surface and a lower surface of the insulation body. The main plate is fastened in the insulation body. The side plate is fastened in the insulation body. The side plate is oppositely disposed to one side of the main plate. The side plate is spaced from the main plate. The main plate has a first corresponding side. The side plate has a second corresponding side. The second corresponding side faces the first corresponding side. The second corresponding side is corresponding to the first corresponding side in the at least one aperture. The first corresponding side and the second corresponding side are exposed to an outside of the insulation body through the at least one aperture. The plurality of the terminals are mounted in the insulation body.

Another object of the present invention is to provide an electrical connector. The electrical connector includes an insulation body, a main plate fastened in the insulation body, two flexible arms and a plurality of terminals. The insulation body has at least one aperture penetrating through at least one of an upper surface and a lower surface of the insulation body. The two flexible arms are disposed to two sides of the insulation body and electrically insulated from the main plate. The two flexible arms are oppositely disposed to two sides of the main plate, and the two flexible arms are spaced from the two sides of the main plate. A part of the main plate and two parts of the two flexible arms are disposed in the at least one aperture. The parts of the main plate and the two flexible arms are exposed to an outside of the insulation body through the at least one aperture. The plurality of the terminals are mounted in the insulation body.

Another object of the present invention is to provide an electrical connector. The electrical connector includes an insulation body, at least one grounding terminal, at least one power terminal, a main plate and a side plate. The insulation body has a docking portion. The docking portion defines at least one aperture penetrating through at least one of a top surface and a bottom surface of the docking portion. The at least one grounding terminal is mounted in the insulation body. The at least one grounding terminal has a contacting portion. The contacting portion of the at least one grounding terminal is disposed at an outermost side of the docking portion. The at least one power terminal is mounted in the insulation body. The at least one power terminal has the contacting portion. The contacting portion of the at least one power terminal is disposed to the docking portion. The contacting portion of the at least one power terminal is disposed adjacent to an inner side of the contacting portion of the at least one grounding terminal. The at least one aperture is formed between the contacting portion of the at least one grounding terminal and the contacting portion of the at least one power terminal. The main plate is fastened in the insulation body. The main plate has a first corresponding side. The side plate is fastened in the insulation body. The side plate is disposed to one side of the main plate. The side plate is spaced from the main plate and electrically insulated from the main plate. The side plate has a second corresponding side. The second corresponding side faces the first corresponding side. The second corresponding side is corresponding to the first corresponding side in the at least one aperture. The first corresponding side and the second corresponding side are exposed to an outside of the insulation body through the at least one aperture.

As described above, the middle plate assembly has the main plate, and the pair of the side plates symmetrically disposed to the two sides of the main plate, the main plate has a base plate, and the base plate has a longitudinal base plate and a horizontal base plate, two first protruding pieces are extended towards the longitudinal base plate from the two sides of a rear end of the horizontal base plate, a middle of a rear end of the longitudinal base plate extends rearward, then extends downward and further extends rearward to form a soldering foot, the soldering foot is soldered to the circuit board and is electrically connected to a detection circuit, each side plate has a locating plate, and the locating plate has a longitudinal extending plate and a transverse extending plate, a front edge of the longitudinal extending plate of each side plate extends towards one first protruding piece to form a second protruding piece, the first protruding piece is arranged corresponding to the second protruding piece along a docking direction of the electrical connector, two sides of the docking portion define the two apertures penetrating through the top surface and the bottom surface of the docking portion, the two first protruding pieces and the two second protruding pieces are received in the two apertures, two locating portions of the two side plates contact with two concave surfaces of a metal shell by a spot welding technology, so the main plate is electrically connected to the metal shell. When water flows into one aperture, the two first protruding pieces of the main plate are electrically connected with the two second protruding pieces of the two side plates, so the main plate is electrically connected with the two side plates. The two locating portions of the two side plates contact with the two concave surfaces of the metal shell by the spot welding technology, so the main plate is electrically connected to the metal shell. In addition, the metal shell is grounded, the middle plate assembly is grounded and the soldering foot is also grounded. When the detection circuit detects that the potential of the soldering foot is changed to a ground, the detection circuit sends a signal to make the electrical connector stop charging or transmitting the signals, so the electrical connector stops working at the time of the water entering the electrical connector to protect the electrical connector. Thus, the electrical connector has a better safety performance for protecting the electrical connector and a user.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
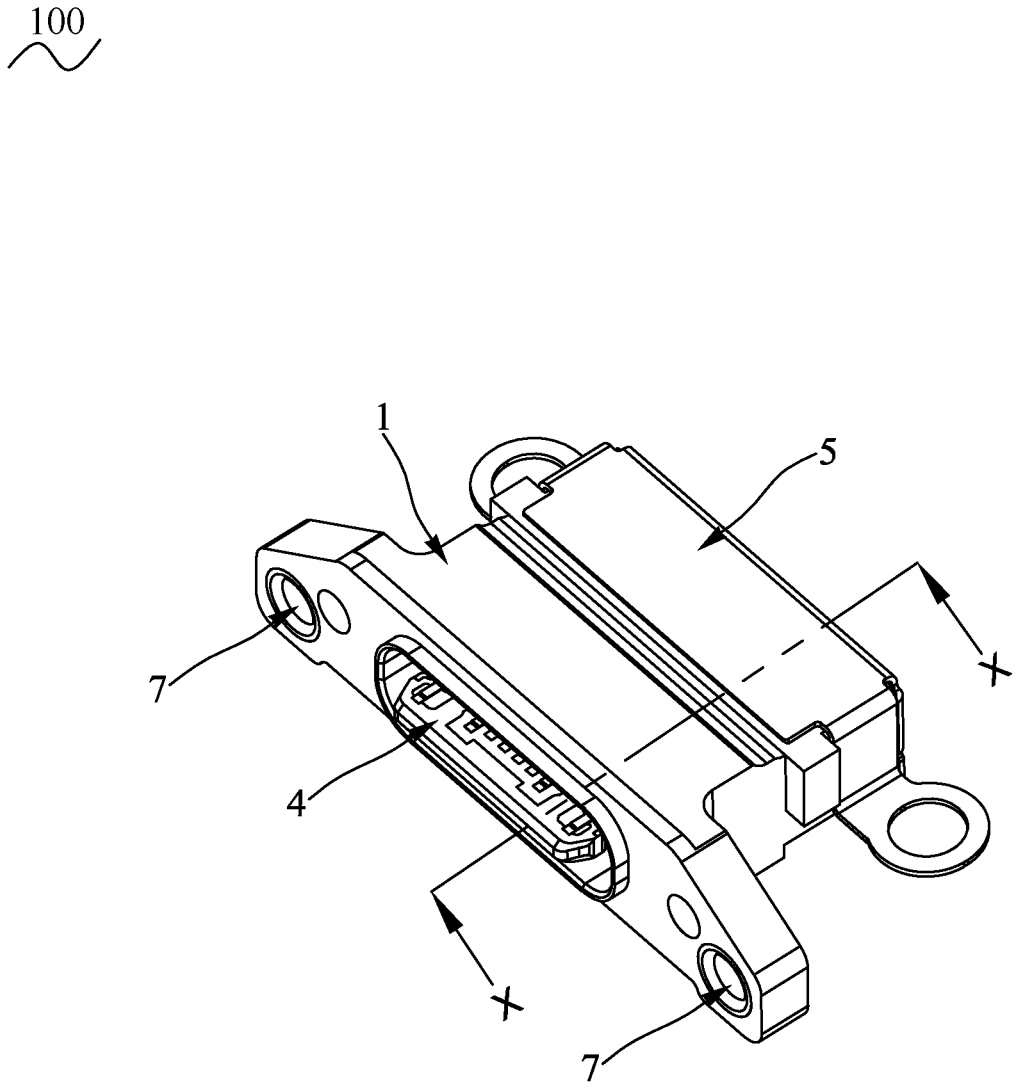
FIG. 1 is a perspective view of an electrical connector in accordance with a preferred embodiment of the present invention.
Figure 2:
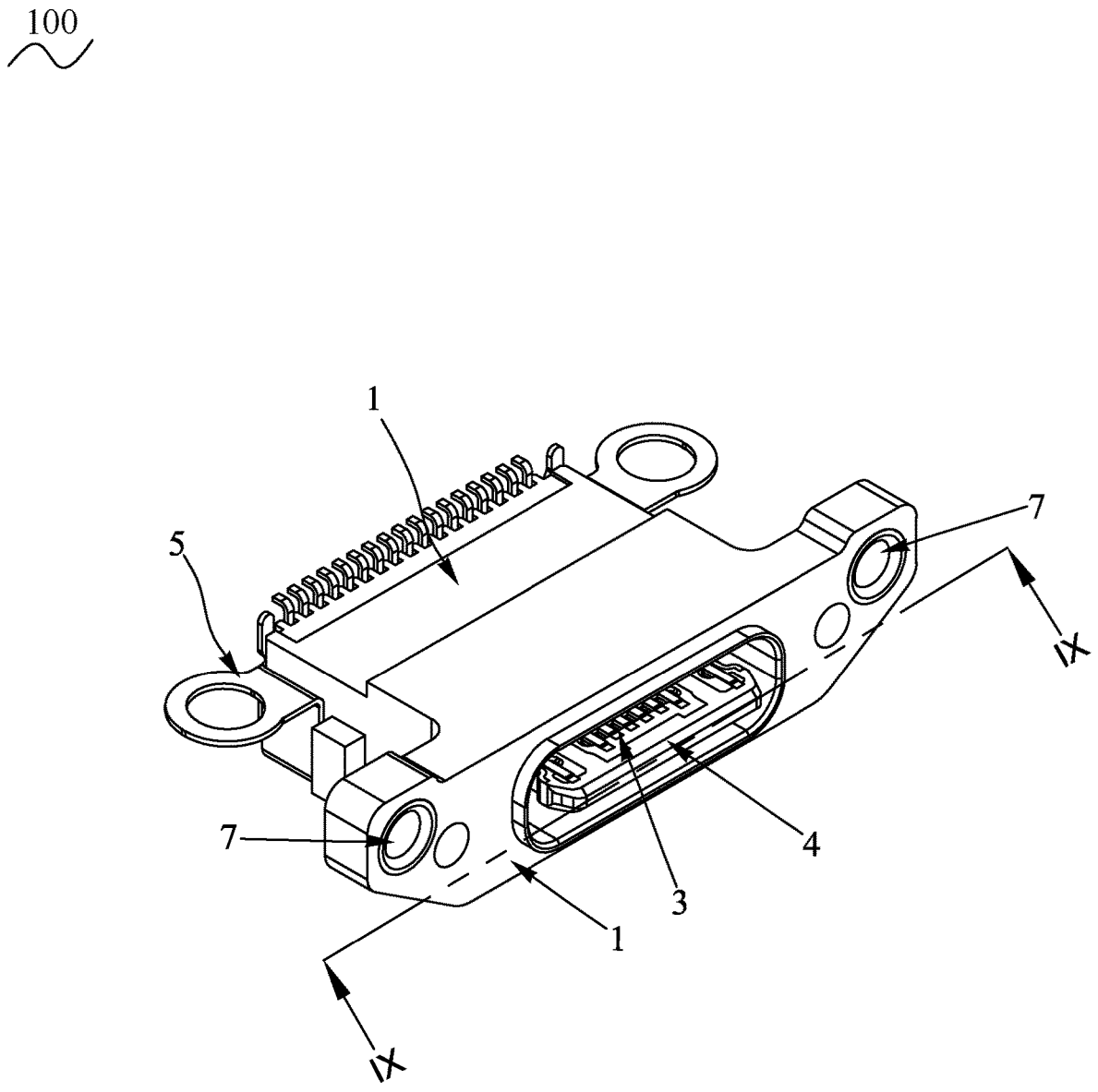
FIG. 2 is another perspective view of the electrical connector in accordance with the present invention.
Figure 3:
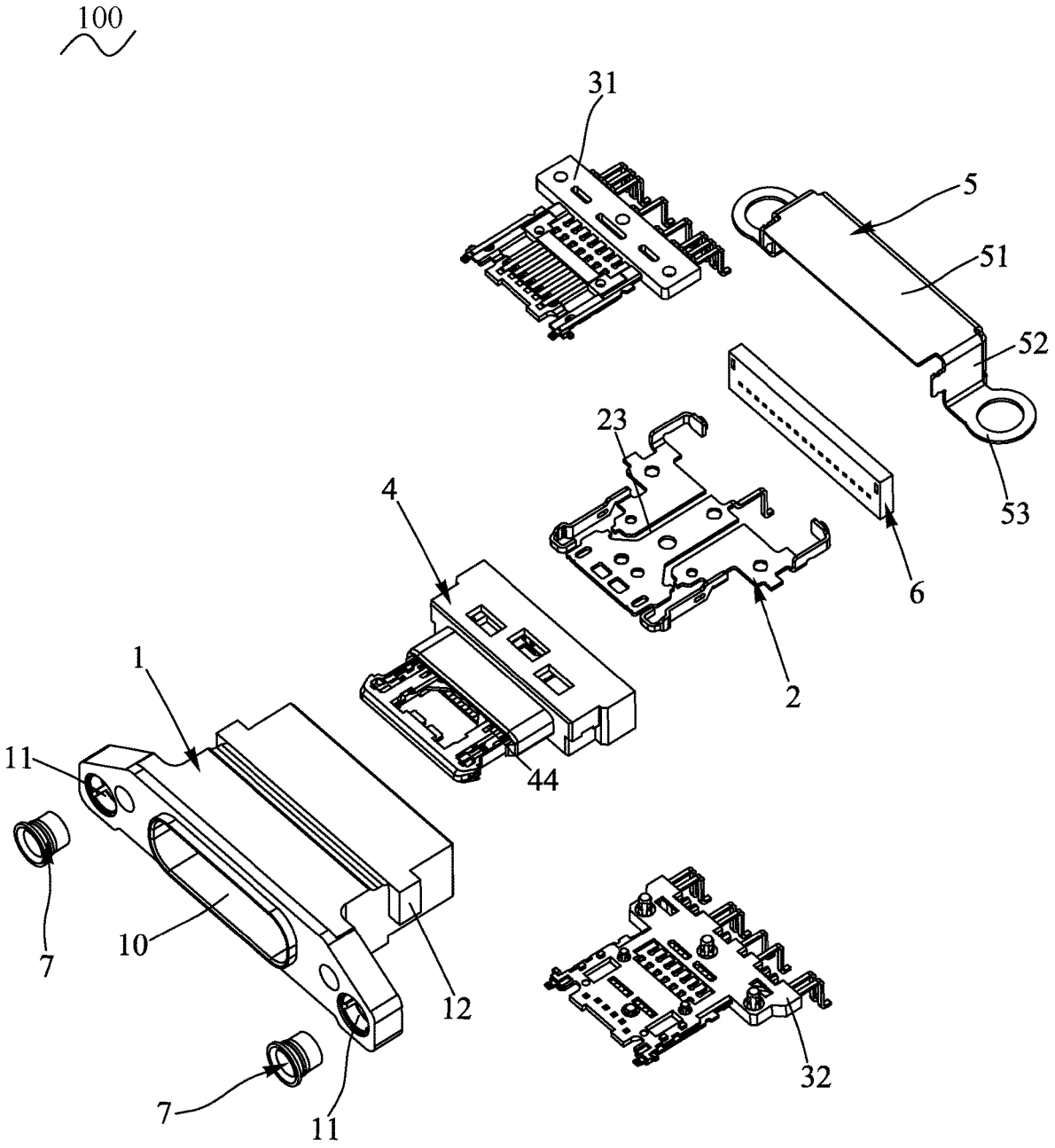
FIG. 3 is an exploded view of the electrical connector in accordance with the present invention.
Figure 4:
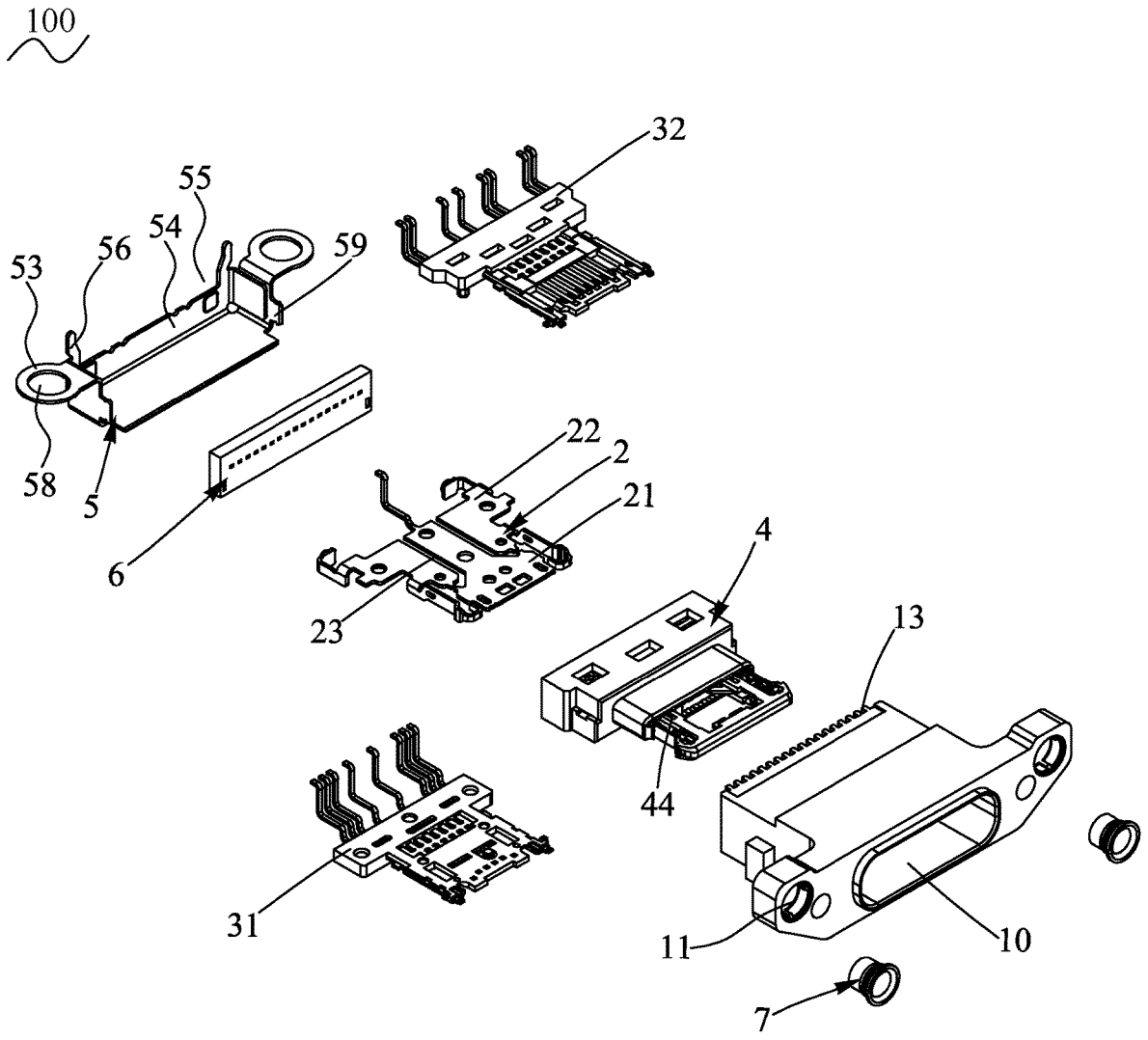
FIG. 4 is another exploded view of the electrical connector in accordance with the present invention.
Figure 5:
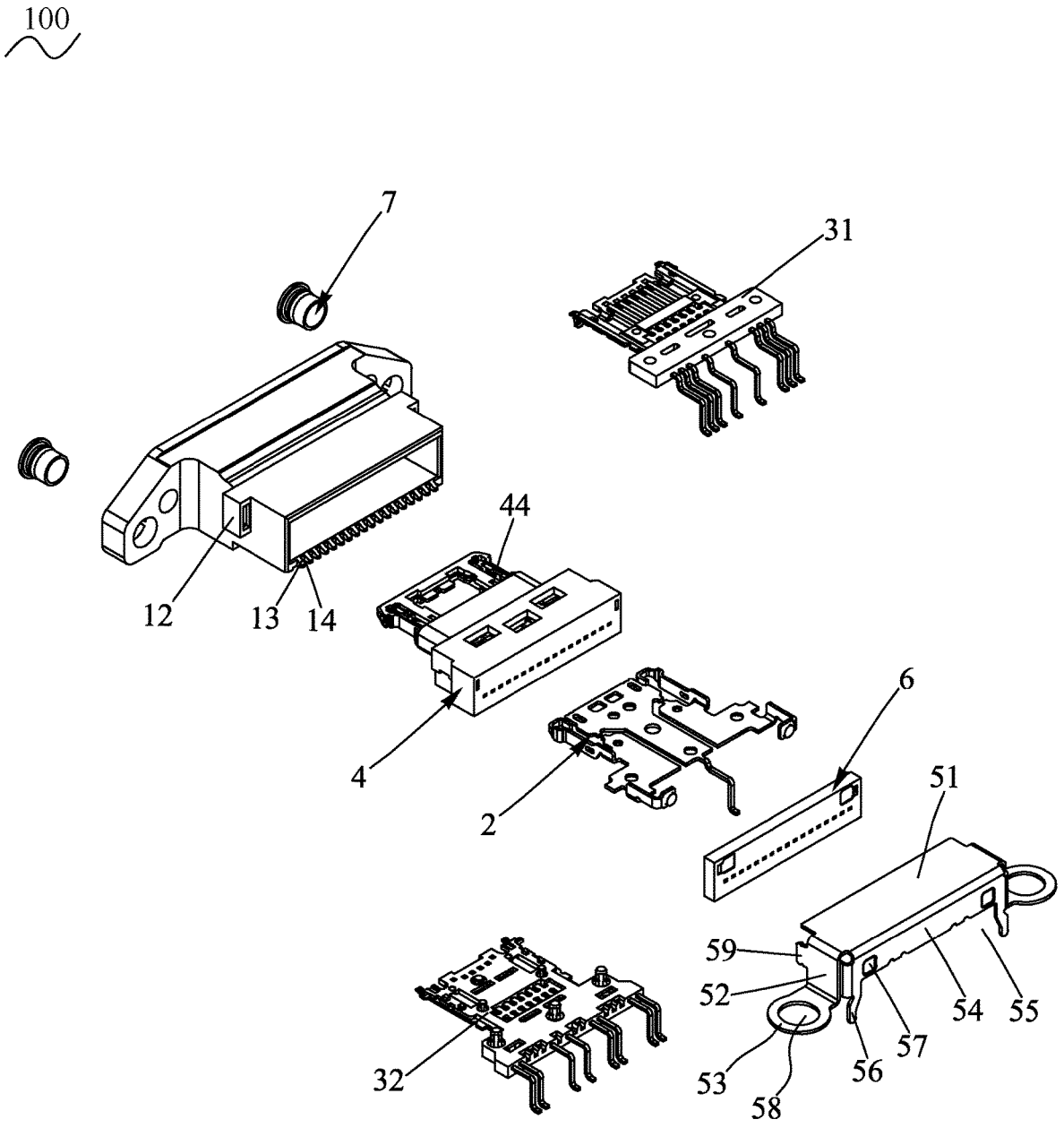
FIG. 5 is one more exploded view of the electrical connector in accordance with the present invention.

Referring to FIG. 1 to FIG. 5, an electrical connector 100 in accordance with a preferred embodiment of the present invention is shown. The electrical connector 100 includes an insulating housing 1, a middle plate assembly 2, a terminal assembly 3, an insulation body 4, a metal shell 5, a glue body 6, at least two bushings 7 and a circuit board 90. The electrical connector 100 is a type C connector. In a concrete implementation, the electrical connector 100 is able to be another type of connector.

The terminal assembly 3 is fastened in the insulation body 4. The middle plate assembly 2 is mounted in a middle of the terminal assembly 3, and the middle plate assembly 2 is fastened in the insulation body 4. The insulation body 4 surrounds the middle plate assembly 2 and the terminal assembly 3. The insulation body 4, the terminal assembly 3 and the middle plate assembly 2 are fastened in the insulating housing 1. The metal shell 5 is fastened to a rear end of the insulating housing 1, and the metal shell 5 is connected to the middle plate assembly 2. The metal shell 5 is used for grounding and shielding an electrical interference.

The glue body 6 is covered to a rear end of the insulation body 4. The glue body 6 is mounted to the rear end of the insulating housing 1. The glue body 6 seals up a gap 101 between the insulating housing 1 and the insulation body 4, so that water is prevented from flowing into a rear end of the electrical connector 100, and the electrical connector 100 is prevented from being damaged due to a water infiltration of the electrical connector 100.

Preferably, the electrical connector 100 includes two bushings 7 and two screw bolts (not shown). The two bushings 7 are fastened to two sides of a front end of the insulating housing 1 to fasten the electrical connector 100. The metal shell 5 is spot welded to the rear end of the insulating housing 1. The metal shell 5 is spot welded to two sides of a rear end of the middle plate assembly 2, so that the metal shell 5 is connected to the middle plate assembly 2. The insulating housing 1 and the insulation body 4 are made of plastics, and the middle plate assembly 2 and the metal shell 5 are made of metals.

Referring to FIG. 3 to FIG. 8, the terminal assembly 3 is arranged in the insulation body 4. The terminal assembly 3 includes an upper terminal assembly 31 and a lower terminal assembly 32. The terminal assembly 3 includes a plurality of terminals 305. The plurality of the terminals 305 are mounted in the insulation body 4. The plurality of the terminals 305 include at least one grounding terminal 302 and at least one power terminal 303. The at least one grounding terminal 302 and the at least one power terminal 303 are mounted in the insulation body 4. Each terminal 305 has a contacting portion 304. The at least one grounding terminal 302 has the contacting portion 304. The at least one power terminal 303 has the contacting portion 304. The upper terminal assembly 31 is mounted on the lower terminal assembly 32. The middle plate assembly 2 is positioned between the upper terminal assembly 31 and the lower terminal assembly 32.

The upper terminal assembly 31 includes a plurality of upper terminals 311 and an upper base body 312. The plurality of the upper terminals 311 are arranged in an upper row. The plurality of the upper terminals 311 are fastened in the upper base body 312. Each upper terminal 311 has an upper fixing portion 313, an upper contacting portion 314 and an upper soldering portion 315. The upper fixing portion 313 is disposed horizontally. The upper fixing portion 313 slantwise extends rearward and outward. A front end of the upper fixing portion 313 extends frontward to form an upper connecting portion 317. A front end of the upper connecting portion 317 extends frontward to form the upper contacting portion 314. A rear end of the upper fixing portion 313 extends rearward and then is bent downward to form an upper bending portion 316. A rear end of the upper bending portion 316 extends rearward, then is bent downward and further extends rearward to form the upper soldering portion 315. The upper bending portion 316 and the upper soldering portion 315 project beyond a rear end of the upper base body 312. The upper base body 312 has an upper main body 3121. A middle of a front surface of the upper main body 3121 extends frontward to form an upper extending portion 3122.

A front end of the upper extending portion 3122 extends frontward to form an upper tongue portion 3123.

The upper fixing portions 313 of the plurality of the upper terminals 311 are fastened in the upper main body 3121 of the upper base body 312. The upper fixing portions 313 of the plurality of the upper terminals 311 are surrounded by the upper main body 3121 of the upper base body 312. The upper connecting portions 317 of the plurality of the upper terminals 311 are fastened to the upper extending portion 3122 of the upper base body 312. A middle of the upper extending portion 3122 defines an upper opening 3120 penetrating through the upper extending portion 3122 along an up-down direction. Middles of the upper connecting portions 317 of the plurality of the upper terminals 311 are exposed to the upper opening 3120.

The upper contacting portions 314 of the plurality of the upper terminals 311 are fastened in the upper tongue portion 3123 of the upper base body 312. The upper contacting portions 314 of the plurality of the upper terminals 311 are partially surrounded by the upper tongue portion 3123 of the upper base body 312. Middles of the upper contacting portions 314 of the plurality of the upper terminals 311 are exposed to a top surface of the upper tongue portion 3123. The upper soldering portions 315 of the plurality of the upper terminals 311 project outward from a rear end of the upper main body 3121 of the upper base body 312. Specifically, the upper terminal assembly 31 includes eight upper terminals 311. The upper base body 312 has a plurality of first positioning holes 3124. The plurality of the first positioning holes 3124 are arranged in corresponding to corresponding structures of the middle plate assembly 2 and corresponding structures of the lower terminal assembly 32.

Two sides of the upper tongue portion 3123 define two upper perforations 3128 along a transverse direction. The plurality of the upper terminals 311 include two upper grounding terminals 3125, two upper power terminals 3126 and a plurality of upper signal terminals 3127. The two upper grounding terminals 3125 are respectively arranged at two outermost sides of the plurality of the upper terminals 311 along the transverse direction. The two upper power terminals 3126 are respectively arranged at the two sides of the plurality of the upper terminals 311. The two upper power terminals 3126 are located to two inner sides of the two upper grounding terminals 3125. The plurality of the upper signal terminals 3127 are arranged in a middle position of the plurality of the upper terminals 311. The plurality of the upper signal terminals 3127 are located between the two upper power terminals 3126. Each upper grounding terminal 3125 is spaced from one upper power terminal 3126 to form an upper interval 318. Each upper grounding terminal 3125 is spaced from the upper contacting portion 314 of the one upper power terminal 3126 to form the upper interval 318.

The lower terminal assembly 32 is matched with the upper terminal assembly 31. The lower terminal assembly 32 includes a plurality of lower terminals 321 and a lower base body 322. The plurality of the lower terminals 321 are arranged in a lower row. The plurality of the lower terminals 321 are fastened in the lower base body 322. Each lower terminal 321 has a lower fixing portion 323, a lower contacting portion 324 and a lower soldering portion 325. The lower fixing portion 323 is disposed horizontally. The lower fixing portion 323 slantwise extends rearward and outward. A front end of the lower fixing portion 323 extends frontward to form a lower connecting portion 326. A front end of the lower connecting portion 326 extends frontward to form the lower contacting portion 324. A rear end of the lower fixing portion 323 extends rearward, then is bent downward and further extends rearward to form the lower soldering portion 325. The lower soldering portion 325 projects beyond a rear end of the lower base body 322. The lower base body 322 has a lower main body 3221, a lower extending portion 3222 and a lower tongue portion 3223. A middle of a front surface of the lower main body 3221 extends frontward to form the lower extending portion 3222. A front of the lower extending portion 3222 extends frontward to form the lower tongue portion 3223.

The lower fixing portions 323 of the plurality of the lower terminals 321 are fastened in the lower main body 3221 of the lower base body 322. The lower fixing portions 323 of the plurality of the lower terminals 321 are surrounded by the lower main body 3221 of the lower base body 322. The lower contacting portions 324 of the plurality of the lower terminals 321 are fastened in the lower extending portion 3222 and the lower tongue portion 3223 of the lower base body 322. The lower contacting portions 324 of the plurality of the lower terminals 321 are partially surrounded by the lower extending portion 3222 and the lower tongue portion 3223 of the lower base body 322.

The lower soldering portions 325 of the plurality of the lower terminals 321 project outside from a rear surface of the lower main body 3221 of the lower base body 322. Several portions of a rear end of a top surface of the lower base body 322 protrude upward and towards the upper base body 312 to form a plurality of positioning pillars 3224. The plurality of the positioning pillars 3224 are arranged transversely. The plurality of the positioning pillars 3224 pass through a corresponding structure of the middle plate assembly 2, and the plurality of the positioning pillars 3224 are fastened in the plurality of the first positioning holes 3124 of the upper base body 312, so that the lower terminal assembly 32 and the middle plate assembly 2 are located to the upper terminal assembly 31, and the upper terminal assembly 31, the lower terminal assembly 32 and the middle plate assembly 2 are fastened with one another. Specifically, the lower terminal assembly 32 includes eight lower terminals 321. The top surface of the lower base body 322 has at least two insertion pillars 301. Two sides of a middle of the top surface of the lower base body 322 protrude upward to form two insertion pillars 301.

Two sides of the lower tongue portion 3223 define two lower perforations 3228 vertically penetrating through the lower tongue portion 3223. The insulation body 4 seals up front ends and rear ends of the two lower perforations 3228 and the two upper perforations 3128.

The plurality of the lower terminals 321 include two lower ground terminals 3225, two lower power terminals 3226 and a plurality of lower signal terminals 3227. The two lower ground terminals 3225 are respectively arranged at the two outermost sides of the plurality of the lower terminals 321. The two lower power terminals 3226 are respectively arranged at two sides of the plurality of the lower terminals 321. The two lower power terminals 3226 are located between the two lower ground terminals 3225. The plurality of the lower signal terminals 3227 are arranged at a middle of the plurality of the lower terminals 321. The plurality of the lower signal terminals 3227 are located between the two lower power terminals 3226. Each lower ground terminal 3225 is spaced from one of the two lower power terminals 3226 to from a lower interval 328. Each lower ground terminal 3225 is spaced from the lower contacting portion 324 of the one of the two lower power terminals 3226 to from the lower interval 328. Specifically, the lower ground terminal 3225 located at one side of the plurality of the lower terminals 321 is spaced from the lower contacting portion 324 of one lower power terminal 3226 to form one lower interval 328. The lower ground terminal 3225 located at the other side of the plurality of the lower terminals 321 is spaced from the lower contacting portion 324 of the other lower power terminal 3226 to form the other lower interval 328.

In this preferred embodiment, the lower main body 3221 of the lower base body 322 is longer than the upper main body 3121 of the upper base body 312. Seen from one side of the electrical connector 100, a rear end of the lower main body 3221 extends rearward, and the rear end of the lower main body 3221 projects beyond the rear end of the upper main body 3121. The rear end of the lower main body 3221 form a plurality of first positioning slots 3229 penetrating through a top surface and a rear surface of the rear end of the lower main body 3221. The upper bending portions 316 of the plurality of the upper terminals 311 are received in the plurality of the first positioning slots 3229. The upper bending portions 316 of the plurality of the upper terminals 311 are fastened to the plurality of the first positioning slots 3229.

Figure 6:
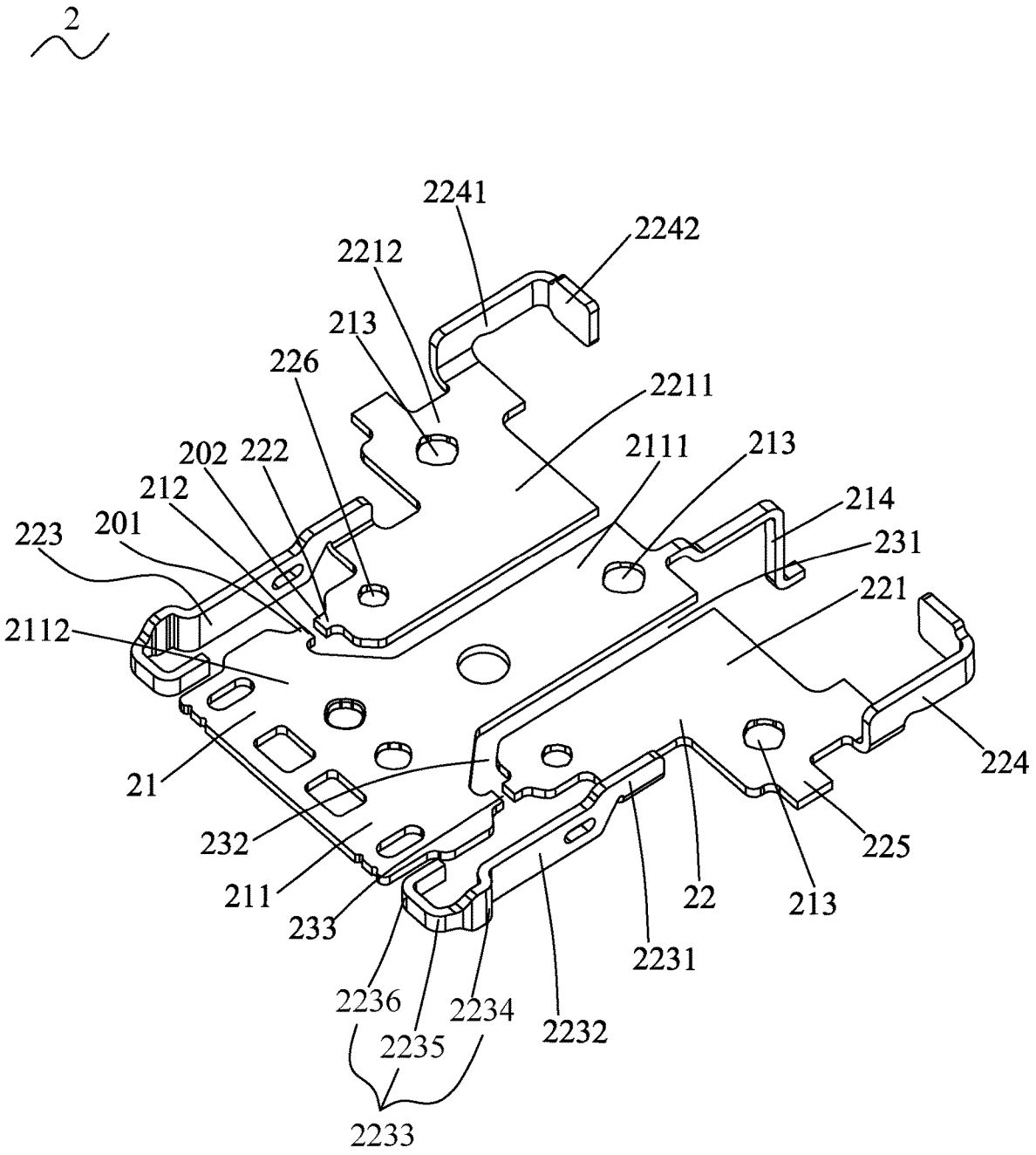
FIG. 6 is a perspective view of a middle plate assembly of the electrical connector in accordance with the present invention.
Figure 7:
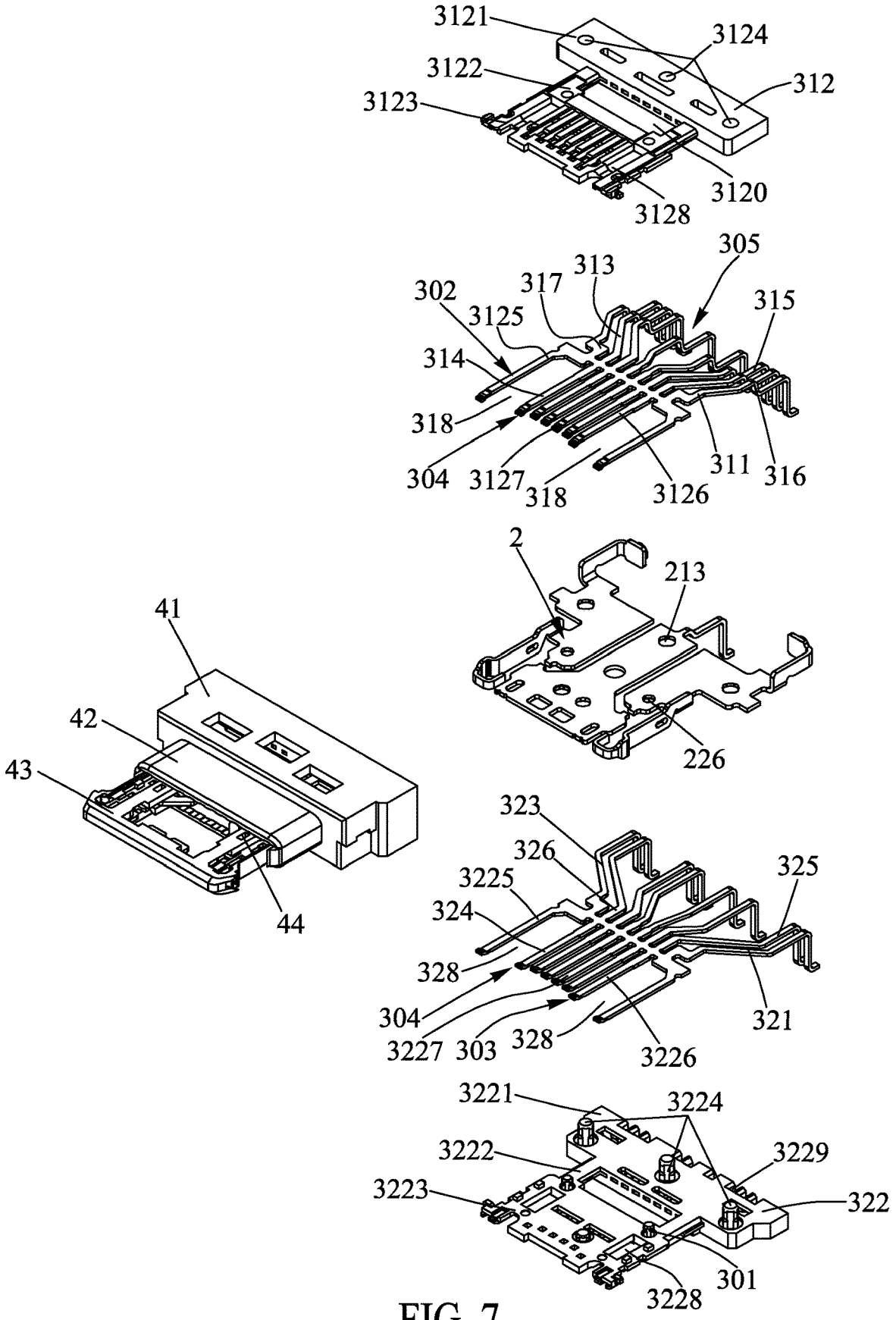
FIG. 7 is a partially exploded view of the electrical connector in accordance with the present invention.
Figure 8:
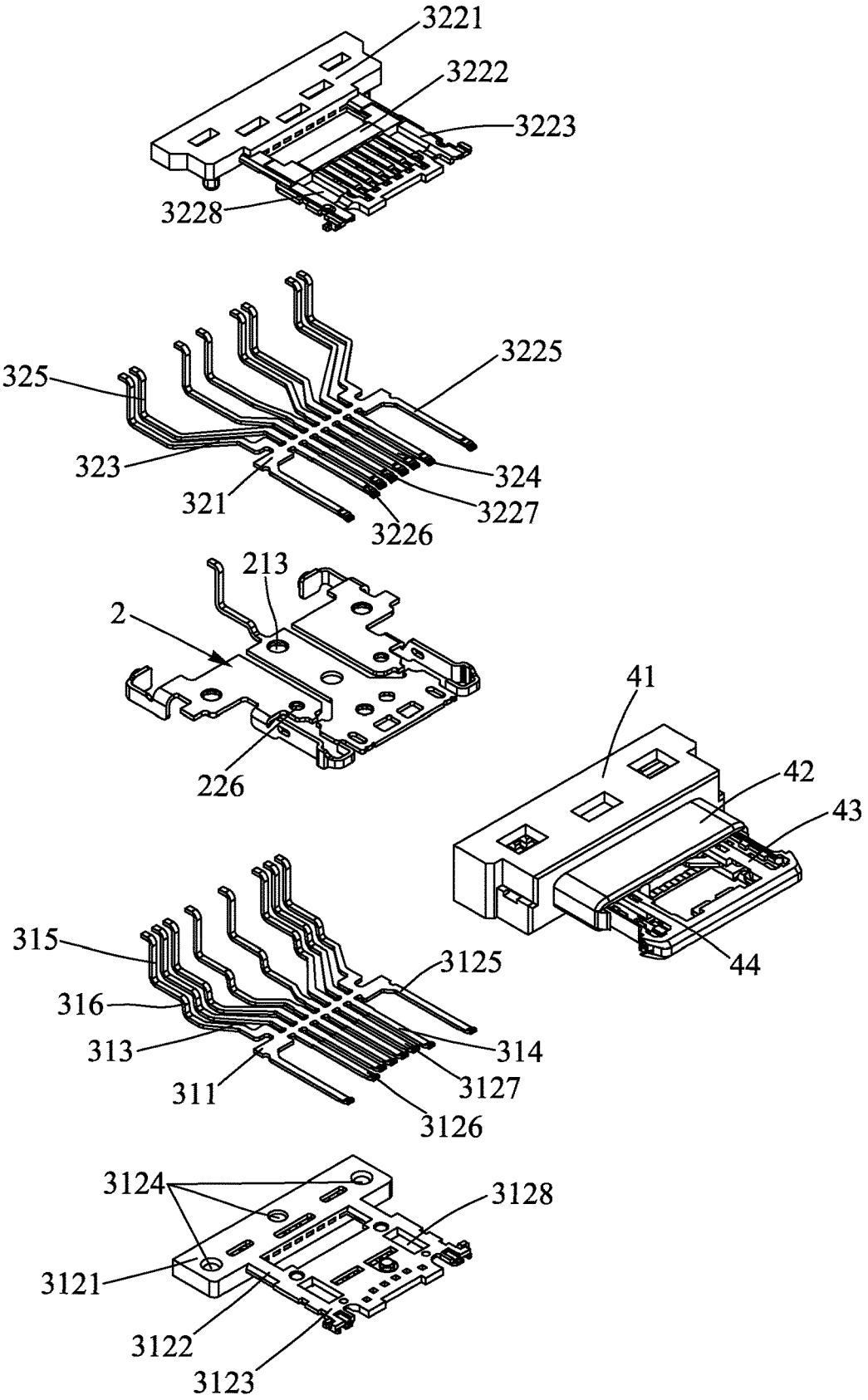
FIG. 8 is another partially exploded view of the electrical connector in accordance with the present invention.
Figure 9:
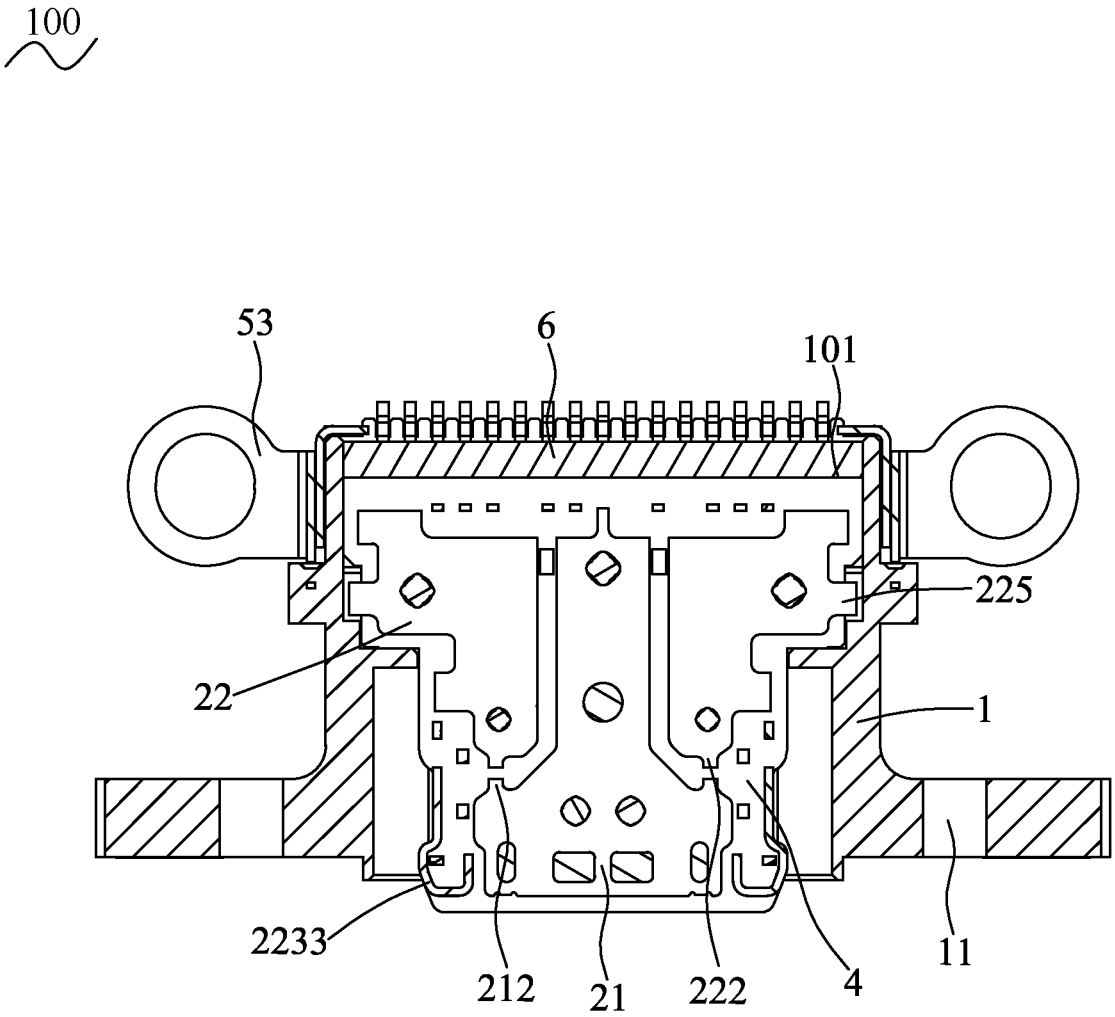
FIG. 9 is a sectional view of the electrical connector along a line IX-IX of FIG. 2.
Figure 10:
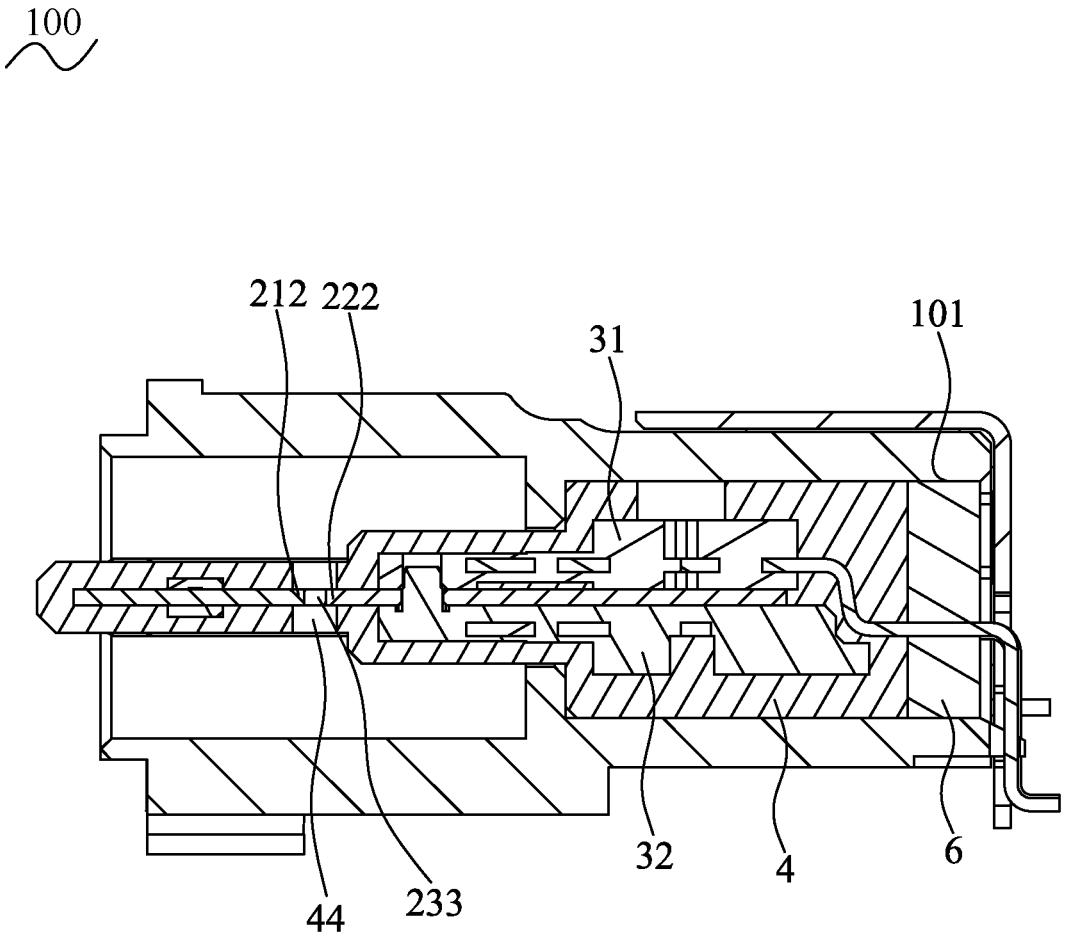
FIG. 10 is a sectional view of the electrical connector along a line X-X of FIG. 1.
Figure 11:
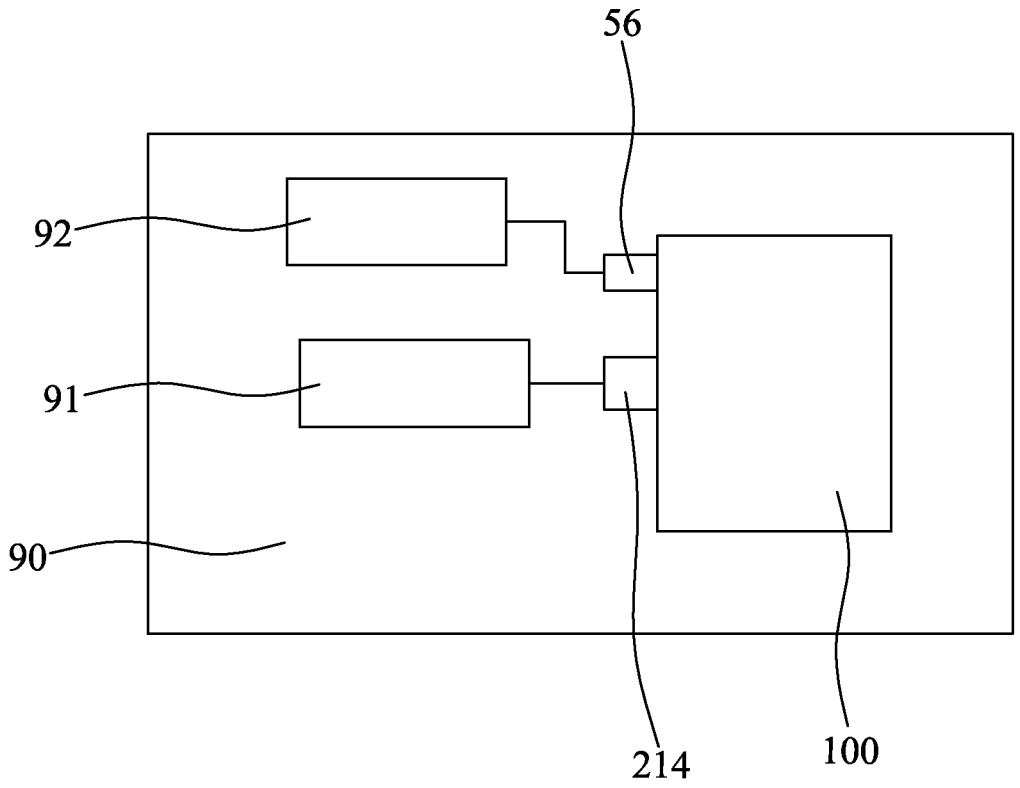
FIG. 11 is a schematic diagram showing that the electrical connector is soldered on a circuit board.

Referring to FIG. 6, the middle plate assembly 2 includes a main plate 21 and a side plate 22. The middle plate assembly 2 has a plurality of first through holes 213 and a plurality of second through holes 226. The main plate 21 and the side plate 22 is fastened in the insulation body 4. The middle plate assembly 2 includes a pair of side plates 22. The main plate 21 is fastened in the insulation body 4. The two side plates 22 are fastened in the insulation body 4. The two side plates 22 are oppositely disposed to two sides of the main plate 21. The two side plates 22 are spaced from the main plate 21. The two side plates 22 are symmetrically disposed to the two sides of the main plate 21. The two side plates 22 are mirrored. The main plate 21 has a base plate 211, two first protruding pieces 212, the plurality of the first through holes 213 and a soldering foot 214. The base plate 211 has a longitudinal base plate 2111 and a horizontal base plate 2112. The longitudinal base plate 2111 is connected to a middle of a rear end of the horizontal base plate 2112 to form a substantially T-shaped structure. Two sides of the rear end of the horizontal base plate 2112 extended towards the longitudinal base plate 2111 to form the two first protruding pieces 212. The two first protruding pieces 212 are arranged corresponding to corresponding mechanisms of the two side plates 22.

The two side plates 22 are two flexible arms. The two flexible arms are disposed to two sides of the insulation body 4 and electrically insulated from the main plate 21. The two flexible arms are oppositely disposed to the two sides of the main plate 21, and the two flexible arms are spaced from the two sides of the main plate 21. A bottom surface of the soldering foot 214 of the middle plate assembly 2, bottom surfaces of the upper soldering portions 315 of the plurality of the upper terminals 311 and bottom surfaces of the lower soldering portions 325 of the plurality of the lower terminals 321 are arranged at a same horizontal plane. The upper soldering portions 315 of the plurality of the upper terminals 311 and the lower soldering portions 325 of the plurality of the lower terminals 321 penetrate through a rear of the insulating housing 1, so that the terminal assembly 3 is located to the insulating housing 1, and the terminal assembly 3 is fastened to the insulating housing 1.

Referring to FIG. 1 to FIG. 11, the plurality of the first through holes 213 penetrate through a top surface and a bottom surface of the base plate 211. The plurality of the positioning pillars 3224 of the terminal assembly 3 pass through the plurality of the first through holes 213 of the middle plate assembly 2, so that the middle plate assembly 2 is located to the terminal assembly 3, and the middle plate assembly 2 is fastened to the terminal assembly 3. A middle of the rear end of the longitudinal base plate 2111 extends rearward, then extends downward and further extends rearward to form the soldering foot 214. The soldering foot 214 penetrates through the rear of the insulating housing 1, so that the middle plate assembly 2 is located to the insulating housing 1, and the middle plate assembly 2 is fastened to the insulating housing 1. The soldering foot 214 is soldered to the circuit board 90 and is without being connected to a ground. A top surface of the soldering foot 214 of the middle plate assembly 2, top surfaces of the upper soldering portions 315 of the plurality of the upper terminals 311, top surfaces of the lower soldering portions 325 of the plurality of the lower terminals 321, top surfaces of the lower fixing portions 323 of the plurality of the lower terminals 321, and top surfaces of the lower connecting portions 326 of the plurality of the lower terminals 321 are all arranged at a same flat plane.

Each side plate 22 has a locating plate 221, a second protruding piece 222, a front bending arm 223, a rear bending arm 224, a stretching piece 225 and at least two second through holes 226. In the preferred embodiment, each side plate 22 has two second through holes 226. The locating plate 221 has a longitudinal extending plate 2211, and a transverse extending plate 2212 extended outward from a rear end of an outer side of the longitudinal extending plate 2211. The transverse extending plate 2212 is connected to the rear end of the outer side of the longitudinal extending plate 2211 to substantially form an L-shaped structure. A front edge of the longitudinal extending plate 2211 of each side plate 22 extends towards one first protruding piece 212 to form the second protruding piece 222. The first protruding piece 212 is arranged corresponding to the second protruding piece 222 along a docking direction of the electrical connector 100. A front end of the outer side of the longitudinal extending plate 2211 is bent upward, then extends frontward, and is further curved outward and rearward to form the front bending arm 223. The two front bending arms 223 of the two side plates 22 are mirrored.

A rear end of an outer edge of the transverse extending plate 2212 is bent upward, then extends rearward, and is further bent inward to form the rear bending arm 224. The two rear bending arms 224 are mirrored. A front end of the outer edge of the transverse extending plate 2212 protrudes outward to form the stretching piece 225. The two stretching pieces 225 are mirrored. The two stretching pieces 225 are fastened in the insulating housing 1, and the two stretching pieces 225 project outside from two sides of the insulating housing 1, so that the middle plate assembly 2 is located to the insulating housing 1, and the middle plate assembly 2 is fastened to the insulating housing 1. The locating plate 221 defines the second through hole 226 penetrating through a top surface and a bottom surface of the locating plate 221. The two insertion pillars 301 of the terminal assembly 3 pass through the two second through holes 226, so that the terminal assembly 3 is located to the middle plate assembly 2, and the terminal assembly 3 is fastened to the middle plate assembly 2.

Each front bending arm 223 has a front bending portion 2231, an extending arm 2232 and a hook portion 2233. The front bending portion 2231 is perpendicularly bent upward from the front end of the outer side of the longitudinal extending plate 2211 of each side plate 22. A front end of the front bending portion 2231 slantwise extends frontward and downward to form the extending arm 2232. A front end of the extending arm 2232 is arched outward, then extends frontward, and is bent towards the main plate 21 and is further bent rearward to form the hook portion 2233.

The hook portion 2233 has a first bending section 2234, a second bending section 2235 and a third bending section 2236. The first bending section 2234 is arched outward, and then extends frontward from the front end of the extending arm 2232. The second bending section 2235 is bent inward and towards the horizontal base plate 2112 of the main plate 21 from a front end of the first bending section 2234. The third bending section 2236 is bent rearward and towards the longitudinal extending plate 2211 of the locating plate 221 from a free end of the second bending section 2235.

The middle plate assembly 2 is received in the insulation body 4. The two front bending portions 2231 of the two front bending arms 223 are received in the insulation body 4, and the two extending arms 2232 of the two front bending arms 223 are partially received in the insulation body 4, so that middle plate assembly 2 is located to the insulation body 4, and the middle plate assembly 2 is fastened to the insulation body 4. Outer surfaces of the front ends of the two extending arms 2232 of the two front bending arms 223 are exposed to two sides of a front end of the insulation body 4. The two first bending sections 2234 of the two front bending arms 223 are exposed outside from the two sides of the front end of the insulation body 4. The second bending section 2235 and the third bending section 2236 are fastened in the insulation body 4, so that the middle plate assembly 2 is located to the insulation body 4, and the middle plate assembly 2 is fastened to the insulation body 4.

The first bending section 2234, the second bending section 2235 and the third bending section 2236 together form the hook portion 2233 for reinforcing a structure strength of the middle plate assembly 2 of the electrical connector 100. The front bending portion 2231, the extending arm 2232 and the hook portion 2233 form the front bending arm 223. The front bending arm 223 is perpendicularly extended upward. The two extending arms 2232 are partially exposed outside from the insulation body 4, and the two front bending portions 2231 are exposed outside from the insulation body 4. The two extending arms 2232 and the two third bending sections 2236 of the two front bending arms 223 are fastened in the insulation body 4 to reinforce a structure of the electrical connector 100.

The rear bending arm 224 has a rear bending portion 2241 and a locating portion 2242. The rear bending portion 2241 is perpendicularly bent upward and then is extended rearward from the rear end of the outer edge of the transverse extending plate 2212 of each side plate 22. The locating portion 2242 is extended inward from a rear end of the rear bending portion 2241. The locating portion 2242 is located behind the transverse extending plate 2212 of each side plate 22. A front end of the rear bending portion 2241 is mounted in the insulation body 4. A rear end of the rear bending portion 2241 and the locating portion 2242 are exposed outside from the rear end of the insulation body 4. The two locating portions 2242 of the two side plates 22 are electrically connected with a rear of an inner surface of the metal shell 5, so that the middle plate assembly 2 is located to the metal shell 5, and the middle plate assembly 2 is fastened to the metal shell 5.

The main plate 21 and the two side plates 22 together form the middle plate assembly 2. The middle plate assembly 2 has two dividing slots 23. One side of the main plate 21 is spaced from one side plate 22 to form one dividing slot 23. The other side of the main plate 21 is spaced from the other side plate 22 to form the other dividing slot 23. The insulation body 4 seals the two dividing slots 23 to fasten the main plate 21 and the two side plates 22 in the insulation body 4. Each dividing slot 23 has a straight slot 231, an oblique slot 232 and a matching slot 233. Each straight slot 231 is arranged between the longitudinal base plate 2111 of the main plate 21 and the longitudinal extending plate 2211 of the one side plate 22. Two inner side walls of the two straight slots 231 of the two dividing slots 23 are defined by two outer edges of the longitudinal base plate 2111 of the main plate 21. Two outer side walls of the two straight slots 231 are defined by two inner side edges of the two longitudinal extending plates 2211 of the two locating plates 221 of the two side plates 22.

A front end of the straight slot 231 of each dividing slot 23 is obliquely extended frontward and outward to form the oblique slot 232. The oblique slot 232 extends towards the front bending arm 223 of the one side plate 22. Two inner side walls of the two oblique slots 232 of the two dividing slots 23 are defined by two junctions of two sides of the rear end of the horizontal base plate 2112 of the main plate 21 and two front ends of the two outer edges of the longitudinal base plate 2111. Two outer side walls of the two oblique slots 232 are defined by two junctions of the two inner side edges and two front edges of the two longitudinal extending plates 2211 of the two side plates 22.

Two outer sides of the two oblique slots 232 of the two dividing slots 23 are connected to the two matching slots 233 of the two dividing slots 23. Two front walls of the two matching slots 233 are defined by the two sides of the rear end of the horizontal base plate 2112 of the main plate 21. Two rear walls of the two matching slots 233 are defined by the two front edges of the two longitudinal extending plates 2211 of the two locating plates 221 of the two side plates 22. Specifically, the two front walls of the two matching slots 233 are defined by two rear surfaces of the two first protruding pieces 212. The two rear walls of the two matching slots 233 are defined by two front surfaces of the two second protruding pieces 222. The two matching slots 233 are formed between the two first protruding pieces 212 and the two second protruding pieces 222.

In the specific implementation, the main plate 21 and the two side plates 22 are able to be formed as a whole. The two side plates 22 are able to be connected by the metal shell 5. The front bending arm 223 and the rear bending arm 224 of each locating plate 221 are connected as the whole by the locating plate 221 to form a pair of bending arms. The front bending arm 223 and the rear bending arm 224 of each locating plate 221 are separated from the main plate 21.

The insulation body 4 has a main body 41, a stage portion 42, a docking portion 43 and at least one aperture 44. The at least one aperture 44 penetrates through at least one of an upper surface and a lower surface of the insulation body 4. Preferably, the at least one aperture 44 penetrates through the upper surface and the lower surface of the insulation body 4. The at least one aperture 44 penetrates through a top surface and a bottom surface of the docking portion 43. In the preferred embodiment, the insulation body 4 has two apertures 44. A middle of a front end of the main body 41 protrudes frontward to form the stage portion 42. A middle of a front end of the stage portion 42 protrudes frontward to form the docking portion 43. Two sides of the docking portion 43 define the two apertures 44 penetrating through the top surface and the bottom surface of the docking portion 43. The two first protruding pieces 212 and the two second protruding pieces 222 of the middle plate assembly 2 are received in the two apertures 44. The two first protruding pieces 212 and the two second protruding pieces 222 of the middle plate assembly 2 are fastened to the insulation body 4. The upper main body 3121 of the upper base body 312 and the lower main body 3221 of the lower base body 322 are assembled in the main body 41. The upper extending portion 3122 of the upper base body 312 and the lower extending portion 3222 of the lower base body 322 are assembled in a rear of the stage portion 42. A rear end of the upper tongue portion 3123 of the upper base body 312 and a rear end of the lower tongue portion 3223 of the lower base body 322 are assembled in a front of the stage portion 42. A front end of the upper tongue portion 3123 of the upper base body 312 and a front end of the lower tongue portion 3223 of the lower base body 322 are assembled in the docking portion 43.

The side plate 22 is oppositely disposed to one side of the main plate 21, the side plate 22 is spaced from the main plate 21. The main plate 21 has a first corresponding side 201. The side plate 22 has a second corresponding side 202. The second corresponding side 202 faces the first corresponding side 201. The second corresponding side 202 is corresponding to the first corresponding side 201 in the at least one aperture 44. The first corresponding side 201 and the second corresponding side 202 are exposed to an outside of the insulation body 4 through the at least one aperture 44. In a specific implementation, the two side plates 22 are corresponding to the main plate 21. The main plate 21 has two first corresponding sides 201. The two side plates 22 have two second corresponding sides 202. The two second corresponding sides 202 face the two first corresponding sides 201. The two second corresponding sides 202 are corresponding to the two first corresponding sides 201 in the two apertures 44, respectively. The two first corresponding sides 201 and the two second corresponding sides 202 are exposed to the outside of the insulation body 4 through the two apertures 44. The two sides of the rear end of the horizontal base plate 2112 of the main plate 21 are defined as the two first corresponding sides 201 of the main plate 21, and the two front edges of the two longitudinal extending plates 2211 of the two side plates 22 are defined as the two second corresponding sides 202 of the two side plates 22. The first corresponding side 201 protrudes towards the side plate 22 to form the first protruding piece 212. The second corresponding side 202 protrudes towards the main plate 21 to form the second protruding piece 222. The first protruding piece 212 is corresponding to the second protruding piece 222 in the at least one aperture 44. A part of the main plate 21 and two parts of the two flexible arms are disposed in the at least one aperture 44. The parts of the main plate 21 and the two flexible arms are exposed to the outside of the insulation body 4 through the at least one aperture 44.

The contacting portion 304 of the at least one grounding terminal 302 is disposed at an outermost side of the docking portion 43. The contacting portion 304 of the at least one power terminal 303 is disposed to the docking portion 43. The contacting portion 304 of the at least one power terminal 303 is disposed adjacent to an inner side of the contacting portion 304 of the at least one grounding terminal 302. The docking portion 43 defines the at least one aperture 44. The at least one aperture 44 is formed between the contacting portion 304 of the at least one grounding terminal 302 and the contacting portion 304 of the at least one power terminal 303. The at least one aperture 44 is corresponding to the upper interval 318 and the lower interval 328 of the terminal assembly 3. The first protruding piece 212 and the second protruding piece 222 are corresponding to the upper interval 318 and the lower interval 328 of the terminal assembly 3.

The upper terminal assembly 31, the lower terminal assembly 32 and the middle plate assembly 2 are manufactured in advance. Then the upper terminal assembly 31, the lower terminal assembly 32 and the middle plate assembly 2 are assembled together, so that the middle plate assembly 2 is positioned between the upper terminal assembly 31 and the lower terminal assembly 32. Finally, the insulation body 4 is over molded to the upper terminal assembly 31, the lower terminal assembly 32 and the middle plate assembly 2 by an injection molding technology. At the moment, the two apertures 44 are corresponding to the two matching slots 233, respectively. The two apertures 44 are corresponding to the two first protruding pieces 212 and the two second protruding pieces 222, respectively.

Referring to FIG. 1 to FIG. 11, in this preferred embodiment, when water flows into one aperture 44, the two first protruding pieces 212 of the main plate 21 and the two second protruding pieces 222 of the two side plates 22 form an electrical conduction, so that the main plate 21 is electrically connected with the two side plates 22. The two side plates 22 are connected to the metal shell 5 by a spot welding technology, so the main plate 21 is further electrically connected to the metal shell 5. Because the metal shell 5 is grounded, the middle plate assembly 2 is also grounded on account of the middle plate assembly 2 being connected with the metal shell 5, and the soldering foot 214 of the middle plate assembly 2 is grounded. The circuit board 90 is equipped with a detection circuit 91. The detection circuit 91 arranged on the circuit board 90 is electrically connected to the soldering foot 214 for detecting a potential of the soldering foot 214. When the detection circuit 91 detects that the potential of the soldering foot 214 is changed to the ground, the detection circuit 91 sends a signal to make the electrical connector 100 stop charging or transmitting signals, so the electrical connector 100 stops working at the time of the water entering the electrical connector 100 to protect the electrical connector 100.

The insulating housing 1 has a receiving cavity 10, at least two second positioning holes 11, at least two assembly sections 12 and a plurality of bumps 13. In the preferred embodiment, the insulating housing 1 has two second positioning holes 11, two assembly sections 12 and two bushings 7. The receiving cavity 10 is formed inside the insulating housing 1. The middle plate assembly 2, the terminal assembly 3, the insulation body 4 and the glue body 6 are received in the receiving cavity 10. Two sides of a front end of the insulating housing 1 form two second positioning holes 11. The two bushings 7 are assembled in the two second positioning holes 11, so that the two bushings 7 are located to the insulating housing 1, and the two bushings 7 are fastened to the insulating housing 1.

Two sides of a middle of the insulating housing 1 protrude outward to form the two hollow assembly sections 12. Two buckling portions 59 of the metal shell 5 are buckled in the two assembly sections 12, so that the metal shell 5 is located to the insulating housing 1, and the metal shell 5 is fastened to the insulating housing 1. Several portions of a lower portion of a rear surface of the insulating housing 1 protrude rearward to form the plurality of the bumps 13. Each two bumps 13 are spaced from each other to form a second positioning slot 14 between the two bumps 13. The upper soldering portions 315 of the upper terminal assembly 31, the lower soldering portions 325 of the lower terminal assembly 32 and the soldering foot 214 of the middle plate assembly 2 pass through the plurality of the second positioning slots 14, so that the middle plate assembly 2, the upper terminal assembly 31 and the lower terminal assembly 32 of the terminal assembly 3 are located to the insulating housing 1, and the middle plate assembly 2, the upper terminal assembly 31 and the lower terminal assembly 32 of the terminal assembly 3 are fastened to the insulating housing 1.

The metal shell 5 has a covering plate 51, two blocking plates 52, two wings 53, a rear plate 54, a notch 55, at least two grounding plates 56, at least two concave surfaces 57, two positioning perforations 58 and the two buckling portions 59. In the preferred embodiment, the metal shell 5 has two grounding plates 56. Two sides of the covering plate 51 extend downward to form the two blocking plates 52. Two bottoms of the two blocking plates 52 oppositely extend outward to form the two wings 53. A rear of the covering plate 51 extends downward to form the rear plate 54. The rear plate 54 shields the glue body 6. A middle of a lower edge of the rear plate 54 is recessed inward to form the notch 55.

The soldering foot 214 of the middle plate assembly 2, the upper soldering portions 315 and the lower soldering portions 325 of the terminal assembly 3 are exposed outside from the notch 55 of the metal shell 5. Two sides of the lower edge of the rear plate 54 extend downward to form the two grounding plates 56. In the specific implementation, the circuit board 90 has a grounding area 92. The two grounding plates 56 of the metal shell 5 are soldered to the grounding area 92 of the circuit board 90 to make the metal shell 5 be grounded. The metal shell 5 is electrically connected to the grounding area 92 of the circuit board 90. The soldering foot 214 and the grounding area 92 form an electrical insulation. Two sides of a rear surface of the rear plate 54 are recessed inward to form two concave surfaces 57. The two concave surfaces 57 are corresponding to the two locating portions 2242 of the two side plates 22 of the middle plate assembly 2, so that the two locating portions 2242 of the two side plates 22 of the middle plate assembly 2 contact with the two concave surfaces 57 for making the two side plates 22 of the middle plate assembly 2 connected with the metal shell 5.

Referring to FIG. 6 to FIG. 10, in this preferred embodiment, when the water flows into the one aperture 44, the two first protruding pieces 212 of the main plate 21 are electrically connected with the two second protruding pieces 222 of the two side plates 22, so the main plate 21 is electrically connected with the two side plates 22. The two locating portions 2242 of the two side plates 22 of the middle plate assembly 2 contact with the two concave surfaces 57 of the metal shell 5 by the spot welding technology, so the main plate 21 of the middle plate assembly 2 is electrically connected to the metal shell 5. In addition, the metal shell 5 is grounded, the middle plate assembly 2 is grounded and the soldering foot 214 of the middle plate assembly 2 is also grounded.

The two wings 53 define the two positioning perforations 58. Each positioning perforation 58 is shown as a circular shape. Two front ends of the two blocking plates 52 protrude frontward and towards the insulating housing 1 to form the two buckling portions 59. The two buckling portions 59 are buckled to the two assembly sections 12 of the insulating housing 1, so that the metal shell 5 is located to the insulating housing 1, and the metal shell 5 is fastened to the insulating housing 1. In the specific implementation, the metal shell 5 is fastened on the circuit board 90 by the two wings 53 and the two positioning perforations 58.

As described above, the middle plate assembly 2 has the main plate 21, and the pair of the side plates 22 symmetrically disposed to the two sides of the main plate 21. The main plate 21 has the base plate 211, and the base plate 211 has the longitudinal base plate 2111 and the horizontal base plate 2112. The two first protruding pieces 212 are extended towards the longitudinal base plate 2111 from the two sides of the rear end of the horizontal base plate 2112. The middle of the rear end of the longitudinal base plate 2111 extends rearward, then extends downward and further extends rearward to form the soldering foot 214. The soldering foot 214 is soldered to the circuit board 90 and is electrically connected to the detection circuit 91. Each side plate 22 has the locating plate 221, and the locating plate 221 has the longitudinal extending plate 2211 and the transverse extending plate 2212. The front edge of the longitudinal extending plate 2211 of each side plate 22 extends towards the one first protruding piece 212 to form the second protruding piece 222. The first protruding piece 212 is arranged corresponding to the second protruding piece 222 along the docking direction of the electrical connector 100. The two sides of the docking portion 43 define the two apertures 44 penetrating through the top surface and the bottom surface of the docking portion 43. The two first protruding pieces 212 and the two second protruding pieces 222 of the middle plate assembly 2 are received in the two apertures 44. The two locating portions 2242 of the two side plates 22 of the middle plate assembly 2 contact with the two concave surfaces 57 of the metal shell 5 by the spot welding technology, so the main plate 21 of the middle plate assembly 2 is electrically connected to the metal shell 5. When the water flows into the one aperture 44, the two first protruding pieces 212 of the main plate 21 are electrically connected with the two second protruding pieces 222 of the two side plates 22, so the main plate 21 is electrically connected with the two side plates 22. The two locating portions 2242 of the two side plates 22 of the middle plate assembly 2 contact with the two concave surfaces 57 of the metal shell 5 by the spot welding technology, so the main plate 21 of the middle plate assembly 2 is electrically connected to the metal shell 5. In addition, the metal shell 5 is grounded, the middle plate assembly 2 is grounded and the soldering foot 214 of the middle plate assembly 2 is also grounded. When the detection circuit 91 detects that the potential of the soldering foot 214 is changed to the ground, the detection circuit 91 sends the signal to make the electrical connector 100 stop charging or transmitting the signals, so the electrical connector 100 stops working at the time of the water entering the electrical connector 100 to protect the electrical connector 100. Thus, the electrical connector 100 has a better safety performance for protecting the electrical connector 100 and a user.

What is claimed is:

1. An electrical connector comprising with improved safety features:

an insulation body having at least one aperture penetrating through an upper surface and a lower surface of the insulation body;

a main plate fastened in the insulation body;

a side plate fastened in the insulation body, the side plate being oppositely disposed to one side of the main plate, the side plate being spaced from the main plate, the main plate having a first corresponding side, the side plate having a second corresponding side, the second corresponding side facing the first corresponding side, the second corresponding side corresponding to the first corresponding side in the at least one aperture, the first corresponding side and the second corresponding side being exposed to an outside of the insulation body through the at least one aperture; and a plurality of terminals mounted in the insulation body.

2. The electrical connector with improved safety features as claimed in claim 1, wherein the insulation body has a docking portion, the plurality of the terminals include at least one grounding terminal and at least one power terminal, each terminal has a contacting portion, the contacting portion of the at least one grounding terminal is disposed at an outermost side of the docking portion, the contacting portion of the at least one power terminal is disposed to the docking portion, the contacting portion of the at least one power terminal is disposed adjacent to an inner side of the contacting portion of the at least one grounding terminal, the docking portion defines the at least one aperture, the at least one aperture is formed between the contacting portion of the at least one grounding terminal and the contacting portion of the at least one power terminal.

3. The electrical connector with improved safety features as claimed in claim 2, wherein the insulation body has two apertures penetrating through the top surface and the bottom surface of the docking portion, the electrical connector includes two side plates fastened in the insulation body, the two side plates are oppositely disposed to two sides of the main plate, the two side plates are spaced from the main plate, the main plate has two first corresponding sides, the two side plates have two second corresponding sides, the two second corresponding sides face the two first corresponding sides, the two second corresponding sides are corresponding to the two first corresponding sides in the two apertures, respectively, the two first corresponding sides and the two second corresponding sides are exposed to the outside of the insulation body through the two apertures.

4. The electrical connector with improved safety features as claimed in claim 3, wherein the main plate and the two side plates together form a middle plate assembly, the middle plate assembly has two dividing slots, one side of the main plate is spaced from one side plate to form one dividing slot, the other side of the main plate is spaced from the other side plate to form the other dividing slot.

5. The electrical connector with improved safety features as claimed in claim 4, wherein the main plate has a base plate, the base plate has a longitudinal base plate and a horizontal base plate, the longitudinal base plate is connected to a middle of a rear end of the horizontal base plate to form a substantially T-shaped structure, two sides of the rear end of the horizontal base plate extend towards the longitudinal base plate to form two first protruding pieces, each side plate has a locating plate, the locating plate has a longitudinal extending plate, and a transverse extending plate extended outward from a rear end of an outer side of the longitudinal extending plate, a front edge of the longitudinal extending plate of each side plate extends towards one first protruding piece to form a second protruding piece, the transverse extending plate is connected to the rear end of the outer side of the longitudinal extending plate to substantially form an L-shaped structure, the first protruding piece is arranged corresponding to the second protruding piece.

6. The electrical connector with improved safety features as claimed in claim 5, wherein each dividing slot has a straight slot, an oblique slot and a matching slot, each straight slot is arranged between the longitudinal base plate of the main plate and the longitudinal extending plate of the one side plate, two inner side walls of the two straight slots of the two dividing slots are defined by two outer edges of the longitudinal base plate of the main plate, two outer side walls of the two straight slots are defined by two inner side edges of the two longitudinal extending plates of the two locating plates of the two side plates, a front end of the straight slot is obliquely extended frontward and outward to form the oblique slot, two inner side walls of the two oblique slots of the two dividing slots are defined by two junctions of two sides of the rear end of the horizontal base plate of the main plate and two front ends of the two outer edges of the longitudinal base plate, two outer side walls of the two oblique slots are defined by two junctions of the two inner side edges and two front edges of the two longitudinal extending plates of the two side plates, two outer sides of the two oblique slots are connected to the two matching slots of the two dividing slots, two front walls of the two matching slots are defined by the two sides of the rear end of the horizontal base plate of the main plate, two rear walls of the two matching slots are defined by the two front edges of the two longitudinal extending plates of the two side plates, the two matching slots are formed between the two first protruding pieces and the two second protruding pieces.

7. The electrical connector with improved safety features as claimed in claim 6, wherein a middle of the rear end of the longitudinal base plate extends rearward, then extends downward and further extends rearward to form a soldering foot, each side plate has a rear bending arm, the rear bending arm has a rear bending portion and a locating portion, the locating portion is extended inward from a rear end of the rear bending portion, the electrical connector further includes a metal shell, the two locating portions of the two side plates are electrically connected with a rear of an inner surface of the metal shell.

8. The electrical connector with improved safety features as claimed in claim 7, further comprising a circuit board, the circuit board being equipped with a detection circuit, the detection circuit being electrically connected to the soldering foot, the circuit board having a grounding area, the metal shell being electrically connected to the grounding area of the circuit board, the soldering foot and the grounding area form an electrical insulation.

9. The electrical connector with improved safety features as claimed in claim 1, wherein the first corresponding side protrudes towards the side plate to form a first protruding piece, the second corresponding side protrudes towards the main plate to form a second protruding piece, the first protruding piece is corresponding to the second protruding piece in the at least one aperture.

10. An electrical connector with improved safety features, comprising:

an insulation body having at least one aperture penetrating through at least one of an upper surface and a lower surface of the insulation body;

a main plate fastened in the insulation body;

two flexible arms disposed to two sides of the insulation body and electrically insulated from the main plate, the two flexible arms being oppositely disposed to two sides of the main plate, and the two flexible arms being spaced from the two sides of the main plate, a part of the main plate and two parts of the two flexible arms being disposed in the at least one aperture, the parts of the main plate and the two flexible arms being exposed to an outside of the insulation body through the at least one aperture; and a plurality of terminals mounted in the insulation body.

11. An electrical connector with improved safety features comprising:

an insulation body having a docking portion, the docking portion defining at least one aperture penetrating through at least one of a top surface and a bottom surface of the docking portion;

at least one grounding terminal mounted in the insulation body, the at least one grounding terminal having a contacting portion, the contacting portion of the at least one grounding terminal being disposed at an outermost side of the docking portion;

at least one power terminal mounted in the insulation body, the at least one power terminal having the contacting portion, the contacting portion of the at least one power terminal being disposed to the docking portion, the contacting portion of the at least one power terminal being disposed adjacent to an inner side of the contacting portion of the at least one grounding terminal, the at least one aperture being formed between the contacting portion of the at least one grounding terminal and the contacting portion of the at least one power terminal;

a main plate fastened in the insulation body, the main plate having a first corresponding side; and a side plate fastened in the insulation body, the side plate being disposed to one side of the main plate, the side plate being spaced from the main plate and electrically insulated from the main plate, the side plate having a second corresponding side, the second corresponding side facing the first corresponding side, the second corresponding side corresponding to the first corresponding side in the at least one aperture, the first corresponding side and the second corresponding side being exposed to an outside of the insulation body through the at least one aperture.

* * * * *